US005458248A

United States Patent [19]

Alain

[11] Patent Number: 5,458,248

[45] Date of Patent: Oct. 17, 1995

[54] DISPLAY RACK FOR SHELVES

[75] Inventor: Francois Alain, Meudon, France

[73] Assignee: George S.A., Paris, France

[21] Appl. No.: 165,650

[22] Filed: Dec. 13, 1993

[30] Foreign Application Priority Data

Dec. 23, 1992 [FR] France ..... 92 15650

[51] Int. Cl.[6] ..... A47F 5/00

[52] U.S. Cl. ..... 211/175; 211/184; 211/153

[58] Field of Search ..... 211/175, 59.2, 211/59.3, 184, 43, 153

[56] References Cited

U.S. PATENT DOCUMENTS

| | | | |
|---|---|---|---|
| 4,460,096 | 7/1984 | Ricci | 211/184 |
| 4,938,365 | 7/1990 | Conway et al. . | |
| 5,085,154 | 2/1992 | Merl | 211/184 X |
| 5,088,607 | 2/1992 | Risaji et al. | 211/59.3 |
| 5,111,942 | 5/1992 | Bernardin | 211/59.3 |
| 5,154,299 | 10/1992 | Hwang | 211/43 X |
| 5,265,738 | 11/1993 | Yablans et al. | 211/184 X |

FOREIGN PATENT DOCUMENTS

| | | |
|---|---|---|
| 2051841 | 4/1972 | Germany . |
| 8532469 | 4/1986 | Germany . |
| 522074 | 6/1940 | United Kingdom . |
| 2185389 | 7/1987 | United Kingdom . |

*Primary Examiner*—Robert W. Gibson, Jr.
*Attorney, Agent, or Firm*—Sandler, Greenblum & Bernstein

[57] ABSTRACT

Display rack for shelves comprising a base designed to constitute a storage plane for objects of various widths. The base is composed of a plurality of juxtaposed elements and at least one sliding rim. Each of the juxtaposed elements comprises a first edge and a second edge formed in such a way that they can accommodate the sliding rim.

22 Claims, 5 Drawing Sheets

DISPLAY RACK FOR SHELVES

BACKGROUND OF THE INVENTION

1. Field of the Invention

The invention relates to a display rack for shelves, enabling placing boxes of products of various widths on a shop shelves.

2. Discussion of Background Information

Display racks enabling the storing and displaying of boxes, tubes or other products sold on shelves in shops, which are made to measure according to the sizes of the packages to be stored on the shelves, are already in use. These display racks are generally suited to the sizes of the shelf for which they have been designed. It is therefore necessary to have a wide range of display racks of various widths available. Moreover, these display racks have often been prepared for a very specific type of packages. In the case of a set of packages of various widths, the number of rows, for every preset width, and the order according to which these packages should be stored, are predetermined and cannot be modified.

The purpose of the invention is to provide a display rack for shelves which avoids the drawbacks afore mentioned.

SUMMARY OF THE INVENTION

The invention relates to a display rack for shelves comprising a base intended to constitute a storage plane of adjustable width and at least a removable separator which should be placed between two rows of objects to be displayed.

According to the invention, such a display rack is characterized in that the base is formed of a plurality of juxtaposed elements and at least a sliding rim. According to this arrangement, every element comprises a first edge and a second edge formed in such a way that they can accommodate the sliding rim, as well as recesses, generally rectangular in shape, in the storage plane and designed for accommodating fasteners of the removable separator.

The display rack according to the invention meets advantageously the constraints set to the various products or packages while avoiding special toolings or mouldings. Moreover, it can advantageously be made out of standardized elements.

The invention also relates to the characteristics described below, considered separately or according to all their technically feasible combinations:

Every juxtaposed element is generally rectangular in shape, and both longer edges of the rectangle constitute the first edge and the second edge of the element.

A display rack made out of rectangular elements corresponds to the preferred embodiment of the invention. It is still conceivable that at least a number of the juxtaposed elements are different in shape from a rectangle in order to suit the display rack of the invention, for instance, to an angular location. Thus, at least one of the elements of the display rack of the invention can have the overall shape of a circle sector.

Each juxtaposed element comprises guiding and locking means designed for mobile mounting of the sliding rim.

The sliding rim comprises a profile shaped as an angle whose first leg is designed to be placed in the same plane as the storage plane and whose other leg, the second leg, offers a bearing surface for the objects stored, and at least one sliding block is fastened to the sliding rim so that the first leg is arranged in a plane which is substantially parallel to the storage plane.

Each sliding block of the sliding rim is formed by a flat profile which is fastened to the rim which slides perpendicularly to the longitudinal stretch of the sliding rim. Preferably, the sliding blocks are corrugated.

In the case of rectangular elements, the sliding block is formed by a straight flat profile. The rectilinear stretch of the profile, and the arrangement of the guiding and locking means of each element of the display rack ensure, due to their co-operation, the mobility of the sliding rim along the juxtaposition of the elements.

In the case of elements having a form different from the rectangular form, for instance in the case of elements in the form of a circle sector, each sliding block is formed by a flat profile whose general shape is that of an arc of circular or any other appropriate geometry to ensure, in co-operation with the arrangement of the guiding and locking means, mobility of the sliding rim along a center line from the first edge to the second edge of the element.

The recesses designed for receiving the fasteners of a removable separator exhibit the general shape of a groove whose ends are directed crosswise with respect to the first and the second edges of the element.

The criteria governing the shape of the groove correspond in their principle to the criteria setting the shape of every sliding block of the sliding rim. Thus, a rectangular element is fitted with recesses having the general shape of a rectilinear groove, whereas an element with the general shape of a circle sector is fitted with recesses representing an arc of a circle.

The recesses generally designed for accommodating the fasteners of a removable separator can also be used for fastening, onto the display rack element, a support fitted with a spring-loaded pusher. Such spring-loaded pushers are particularly advantageous when it is desired to provide a feeding of the objects in place every time an object is removed from the row.

Every removable separator comprises a partition to be mounted at an angle with respect to a storage plane, and, at least, one fastening arm whose one end is fastened to the partition whereas the other is fitted with a fastening head designed to engage into one of the recesses formed in the storage plane. The fastening head is offset with respect to the symmetric plane of the partition.

To enable storing boxes on top of one another or storing high objects with narrow bases, the partition can be elevated using an extension that can be clipped or plugged to the partition.

Besides, the separators can be added or replaced with, shimming means of a certain width at a level above that of the storage plane. Such shimming means enable amongst other things storage and alignment of cream tubes placed on their plugs and other objects with a greater width at a different level from that of the base on which they are placed.

Every juxtaposed element comprises a third edge designed to constitute a front rim of the display rack's base and to accommodate an information-carrying front panel. The front panel can be moulded in order to represent a pattern chosen by the user and in the width of each element.

The front panel, however, can also be taken from an extruded panel, cut to the width of at least a portion of the display rack width, preferably cut to the total width of the display rack. In all cases, the front panel can be snapped, clicked or mounted in any other way to the front rim of the base of the display rack, preserving the removable feature of the front panel.

Besides, the front panel can be formed in order to exhibit a pivoting portion designed for receiving pieces of information on the displayed objects. These pieces of information can be affixed on the pivoting portion in the form of an adhesive label of a label slipped into a frame provided for this purpose.

Alternately, the elements of the display rack can be formed, themselves, in order to accommodate beneath the storage plane, beneath the objects displayed on the shelf, a sliding flap carrying pieces of information on the products or the objects placed on the shelf.

To ensure stability of the display rack, means designed to guarantee removability while providing sufficiently rigid fastening of the first edge to the second edge of both corresponding juxtaposed elements, must be available. According to the invention, the first edge and the second edge of every element are fitted with at least two dovetails. The dovetails are male or female. The distribution of the male and female dovetails on the first edge and the second edge is not restricted providing the second edge of every element is fitted with the same number of dovetails as the first edge and that the type of every dovetail of the second edge is complementary to the type of the corresponding dovetail of the first edge.

BRIEF DESCRIPTION OF THE DRAWINGS

Other characteristics and advantages of the invention will be apparent from the description of an embodiment of the invention referring to the appended drawings.

In the appended drawings.

DETAILED DESCRIPTION OF THE PREFERRED EMBODIMENTS

Figures 1, 1A:
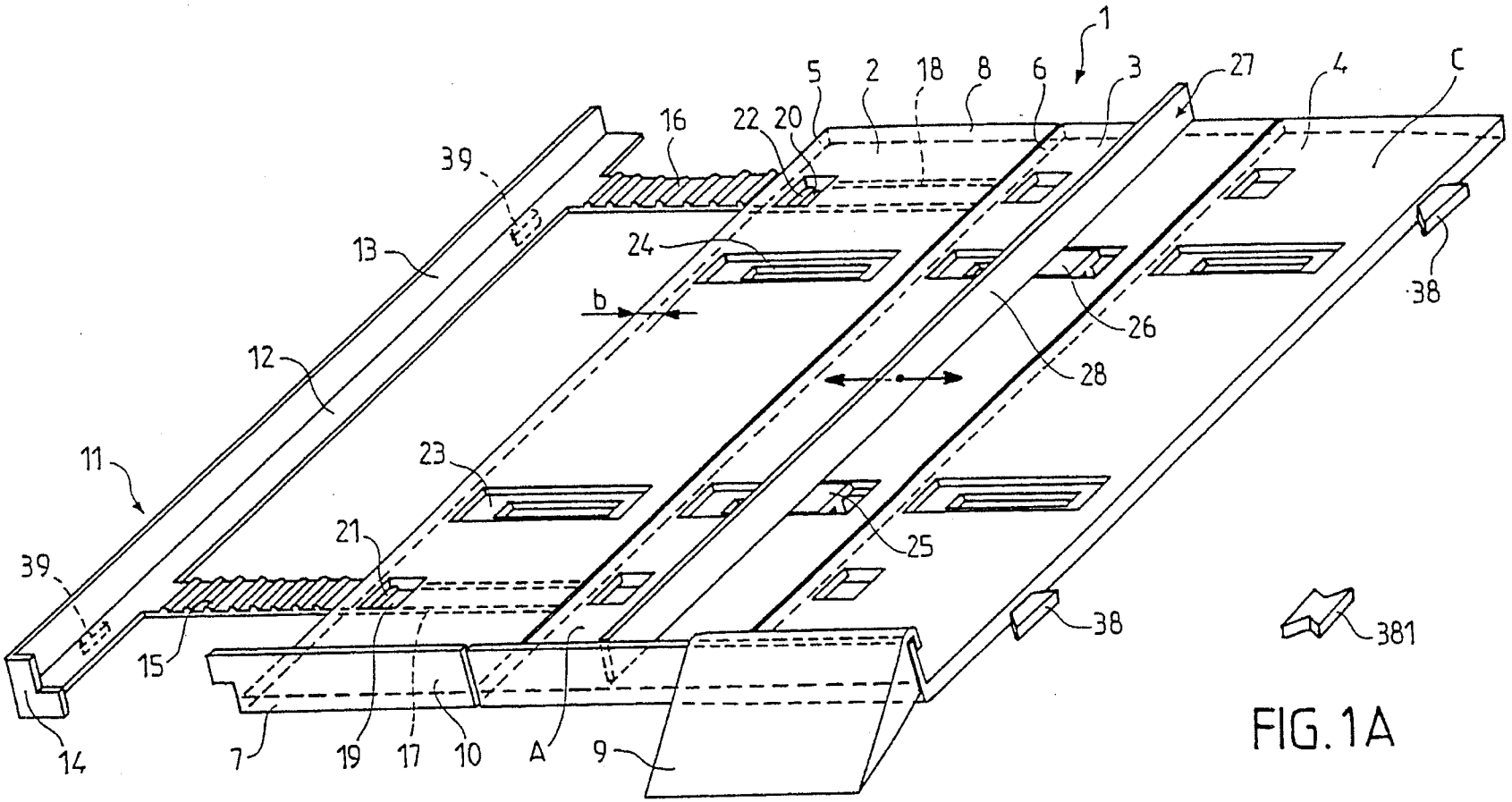
FIGS. 1 and 1A represent three juxtaposed elements of a display rack according to the invention.

As a preferred embodiment of the invention, FIG. 1 represents a display rack designed to stand on a shelf or instead of a shelf, in a storage piece of furniture designed for the display of all sorts of products sold on shelves in a shop, regardless of the package width of these products.

The display rack comprises a base 1 designed to exhibit a storage plane A on which the sale items, designated hereafter as objects, are stored. The base 1 is formed by a plurality of juxtaposed elements, with FIG. 1 only showing the elements 2, and 4. Because elements 2, 3 and 4 are identical, the description of the element 2 is valid in a comparable way for the other elements 3 and 4 shown in FIG. 1 and for the other elements shown quite schematically in FIG. 10.

The element 2 is generally rectangular in shape and comprises a storage surface C defined by a first edge 5, a second edge 6, a third edge 7 and a fourth edge 8. The first edge 5 and the second edge 6 represent the longest sides of the rectangle and are designed for engaging the first and second edges of juxtaposed elements. The third edge 7 is designed for constituting a front rim of the base 1 of the display rack and to accommodate a front panel 9 which can carry pieces of information related to the objects stored on the display rack. The front panel 9 can be attached, in a removable way, directly to the third edge 7 of the element 2. It is however preferable to fit the third edge 7 with a rim 10 integral with the element 2.

The front panel 9 is made of a profile cut to the length of the element 2. The front panel 9 is snapped to the front rim 10.

As the element 2 has a definite width, the width of a display rack that can be obtained by juxtaposition of a plurality of elements 2 would be limited to a multiple integer of the width of the element 2, if no provisions had been made for providing the element 2 with a sliding rim 11. The sliding rim 11 is made of an angular profile with a first leg 12 and a second leg 13. The first leg 12 is designed to be arranged in the same plane as the storage surface C of the element 2, and thus in the same plane as the storage surface A of the base 1. The second leg 13 is designed to act as a bearing surface for the objects to be stored. The sliding rim 11 is substantially identical in length with that of the first edge 5 of the element 2. A rim 14, connected to the sliding rim 11 is arranged to provide an extension of the front rim 10 of the element 2.

Two sliding blocks 15 and 16 are fixed rigidly to the profile of the sliding rim 11 and extend along a plane substantially parallel to that of the first leg 12. Each sliding block 15 and 16 is formed by a flat and notched flat profile, arranged crosswise with respect to the longitudinal stretch of the sliding rim 11.

As an alternate arrangement to this arrangement, it is conceivable that the sliding rim 11 is fitted with only one sliding block. In order to obtain the same positioning stability of the sliding rim with respect to the element 2 as with the embodiment represented on FIG. 1, the width of the sole sliding block, measured in the direction of the longitudinal stretch of the sliding rim 11, must be noticeably larger than that of a sliding block 15 or 16.

The sliding rim 11 is mounted on the element 2 by means of rails 17 and 18 laid on a surface of the element 2 opposite the one constituting the storage surface C of the element 2.

In order to ensure automatic locking of the sliding rim 11 with respect to the element 2, two rectangular slots 19 and 20 are provided from the storage surface C. The slots 19 and 20 are aligned with the corresponding rails 17 and 18. On the opposite side, with respect to the storage surface C, the edges of both slots 19 and 20 are each fitted, in the section parallel to the first edge 5, with a protuberance 21, 22, with the form of a cam designed to co-operate with the corrugation of the sliding blocks 15 and 16, respectively.

The element 2 also comprises two recesses 23 and 24 generally rectangular in shape. The recesses 23 and 24 are directed substantially parallel to the third edge 7 and the fourth edge 8 of the element 2, i.e., in the width direction of the display rack.

Figure 2:
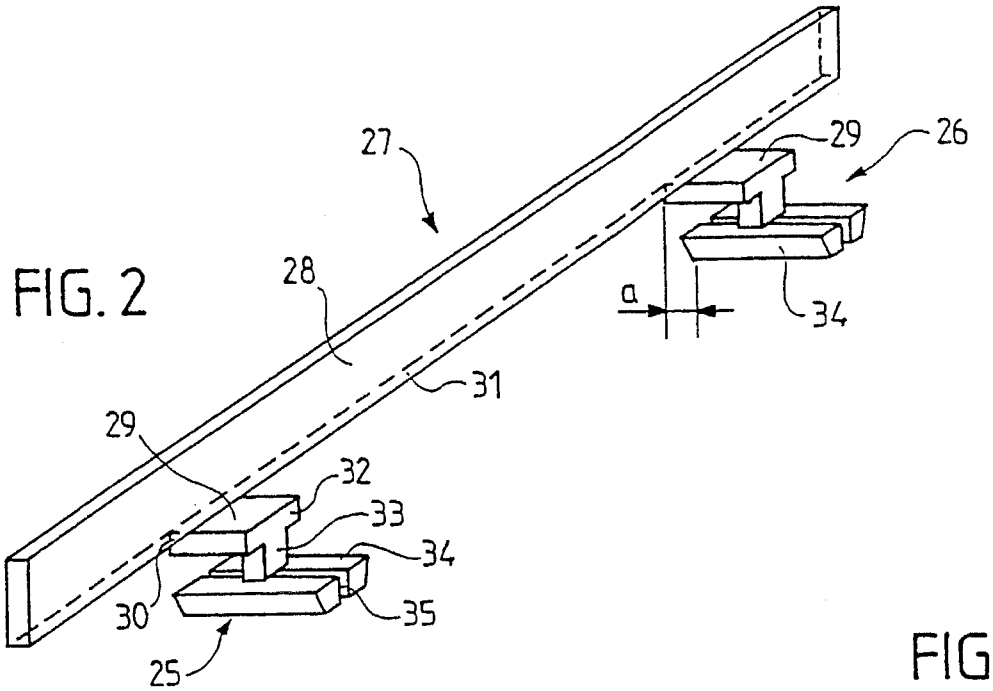
FIG. 2 represents a removable separator.

The recesses 23 and 24 are formed in such a way that they can accommodate fastening means 25 and 26 of a removable separator 27. The removable separator 27 comprises a partition 28 whose length corresponds to that of the element 2. The partition 28 is designed to be mounted at an angle in a removable way, with respect to the storage surface C of the element 2 between two rows of objects to be displayed. In order to ensure stable positioning, variable positioning in relation to the width of the objects to be stored as well as the possibility to place the removable separator in any other position in order to avoid all constraints as regards the lay-out selection of the storage plane A of the display rack, the fasteners 25, which are identical to the fasteners 26, comprise a fastening arm 29 attached by one of its ends, referred to as 30 (FIG. 2), to a lower face 31 of the partition 28, then crosswise with respect to the longitudinal stretch of the latter.

The other end of the fastening arm 29, referred to as 32, rests, by means of a finger 33, on the fastening head 34 designed to engage into the recess 23. The fastening head 34 has the general shape of a parallelepiped whose longitudinal stretch is directed crosswise with respect to that of the partition 28. In order to ensure fastening which is sufficiently rigid, without resorting to screws nor any other fastening means, the fastening head 34 is fitted with a longitudinal slot 35 conferring to the head 34 certain elasticity crosswise with respect to the head 34.

The length a of the fastening arm 29 is selected so that its offset between the partition 28, represented by its plane of symmetry, and the end close to the fastening head 34 is at least equal to the width b of the bridge between the first edge 5 and the second edge close and parallel to the recess 23, or 24 respectively, accommodating the fastening head 34. This arrangement enables to mount the removable separator 27 equally on one or the other of these juxtaposed elements, if, according to the width of the objects to be stored, the partition 28 would be located on, or close to, the junction of both these elements. Thanks to the lay-out symmetry of the fastening elements 25 and 26 with respect to the longitudinal stretch of the partition 28, the removable separator 27 can be mounted on the element 2, so that the fastening means 25 is fixed in the recess 23 or alternately in the recess 24. The fastening element 26 is then placed respectively in the recess 24 or the recess 23.

Generally speaking, the partitions 28 have a height comprised between 20 and 30 mm. This height is sufficient for most objects to be stored on the display rack.

It is however conceivable that the objects of a row must be stored not only one behind another but also one on top of the other. Such a storage system could be interesting for instance for small-sized boxes or for elongated objects, such as pencils.

It is also conceivable that the objects to be stored have a very elongated shape and are light, which makes their maintaining in an upright position quite difficult if they rest solely on their bases.

Figure 3:
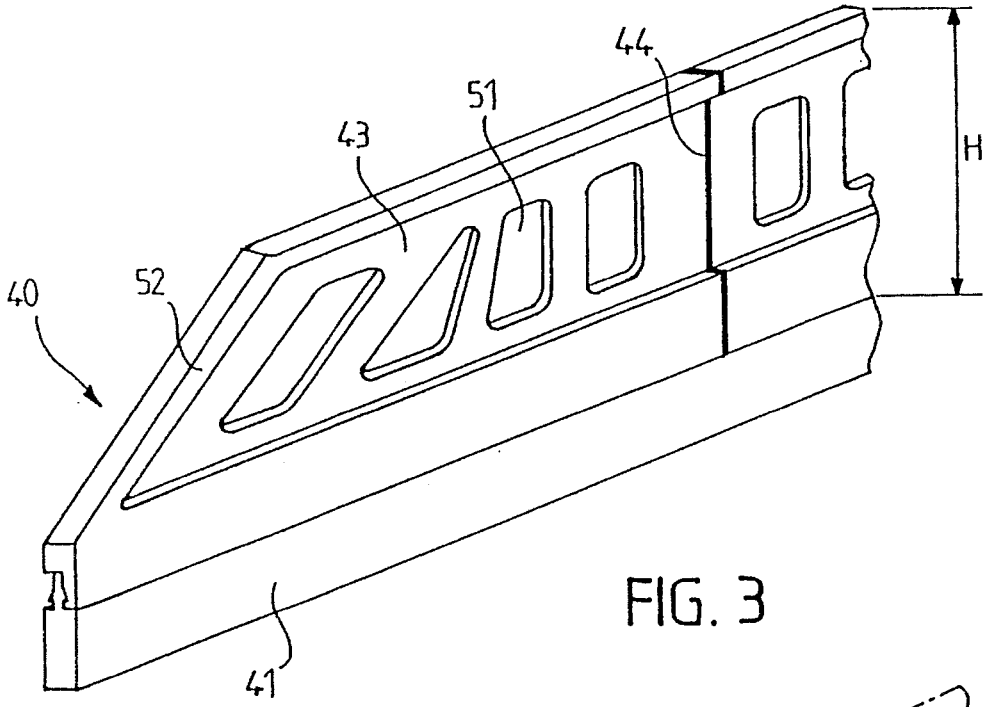
FIG. 3 represents a removable separator fitted with an extension in order to form a raised separator.
Figure 4:
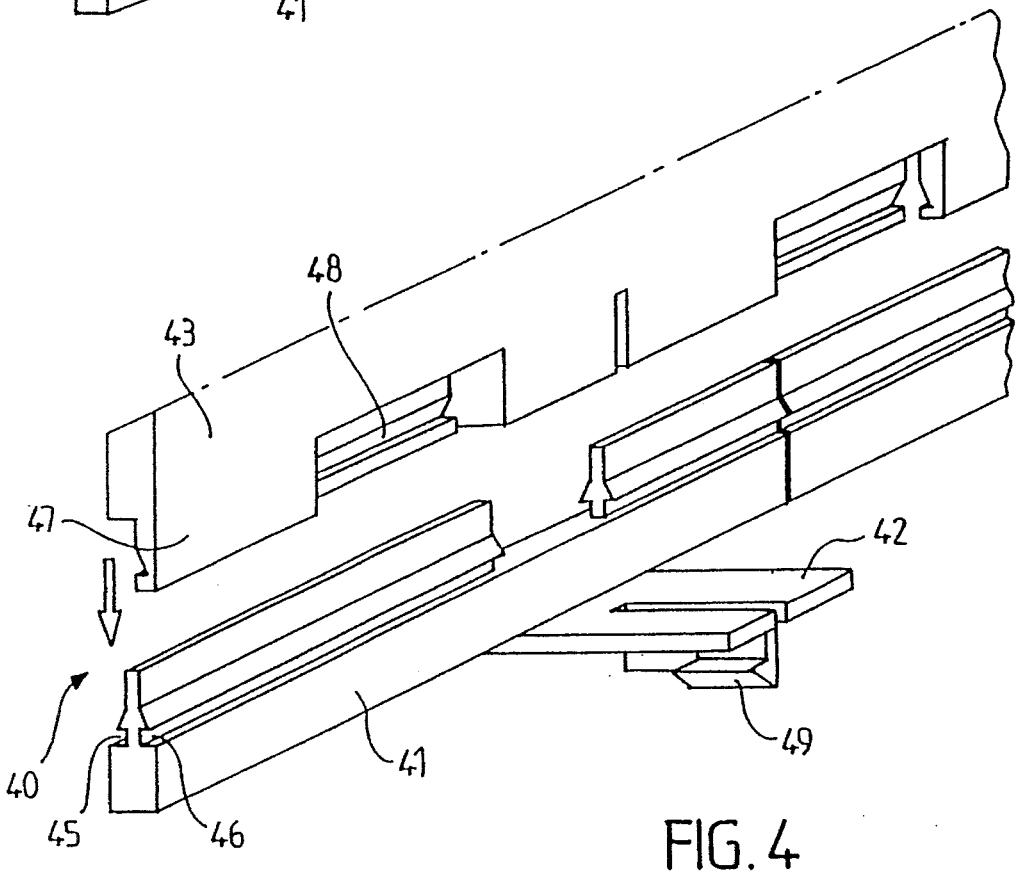
FIG. 4 represents in detail the fastening of an extension on a separator.

In order to facilitate the storage of objects meeting the above criteria, the partition can be elevated. FIGS. 3 and 4 show the principle of such an elevated partition 40.

The elevated partition 40 comprises a partition 41 designed to be mounted on an element of the display rack by means of a fastening lug 42 and thus corresponding approximately to the partition 28 described above. Moreover, the partition 40 comprises an extension 43 of a general flat and elongated shape. The extension 43 is designed for placement in the same plane as the partition 41.

The extension 43 is approximately comparable in length to the partition 41 and has a height H. The height H is selected in relation to the products to be stored. Preferably, it ranges from 80 to 150 mm. For improved flexibility, during the arrangement of the display rack, the extension 43 can be cut along the clipping lines 44 designed for this purpose.

In order to obtain a stable as well as straightforward fastening of the extension 43 on the partition 41, the upper part of the partition 41 can be fitted with grooves 45 and 46 located at the same distance from the upper edge of the partition 41 and parallel to the latter.

Conversely, the extension 43 is formed along the edge which should face the partition 41, in order to provide hooks 47 and 48 directed respectively crosswise with respect to the longitudinal stretch of the extension 43. The shape of the hooks 47 and 48 matches that of the upper portion of the partition 41. Thus, the extension 43 is clipped to the partition 41, alternately in one of the grooves 45 and 46.

The extension 43 is illustrated in FIG. 3 with slots 51 of different shapes and with a bevelled front face 52. 0f course extension 43 can be produced without any slots and with a straight front face, i.e., without any bevels.

The fastening lug 42 corresponds in its design principle to the fastening means 25 and 26 described above and illustrated in FIG. 2. The fastening lug 42 constitutes however a variant to the fastening means 25 and 26 in that the fastening head has been replaced with a hook 49. The hook 49 has a flexibility corresponding to that of the fastening head 34 described above and enables fastening the elevated partition 40 into recesses 23 or 24 of the element 2 of the display rack described above.

The partition 41 fitted with one or several fastening lugs 42, may of course constitute as such a separator for the display rack of the invention. Thus, the extension 43 can be considered as an accessory for such a separator.

Figure 5A:
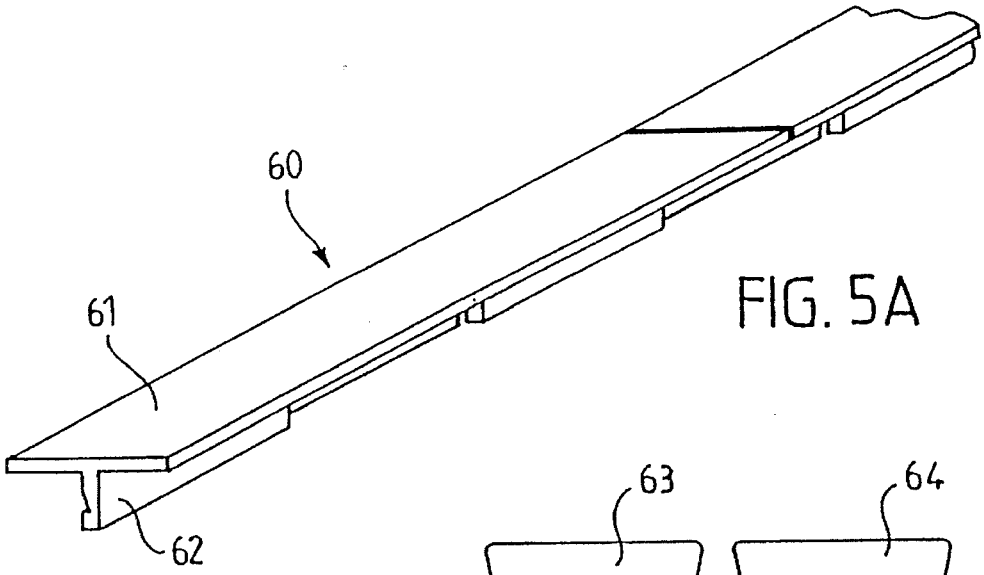
FIG. 5A represents a shim.
Figure 5B:
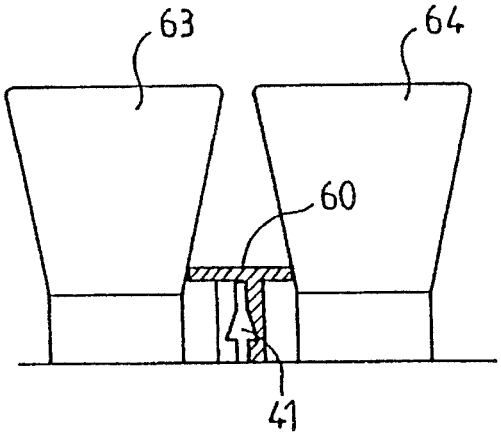
FIG. 5B represents the shim of FIG. 5A located between two objects standing on the display rack of the invention.

FIGS. 5A and 5B represent a shiming piece or shim 60, as another accessory for a separator of the display rack of the invention. The shim 60 comprises a flat and elongated portion 61 in a generally rectangular shape, fitted on one of its larger faces, with hooks 62, mounted at an angle with respect to this surface. The hooks 62 are directed, preferably, alternately crosswise in one direction and the other with respect to the longitudinal stretch of the shim 60, so that the shim 60 can be clipped to the partition 41. As the shim 60 is mounted on the partition 41, both these parts make up a separator with a T-shaped cross-section.

The shim 60 is used among other things for aligning and storing objects of irregular shapes and, especially as shown as an example on FIG. 5B, for aligning and storing on an element 2 of the display rack, cream tubes 63, 64 standing on their plugs or for any other objects whose shape has a maximum width at a certain distance from the object face on which the latter is resting.

Figure 6:
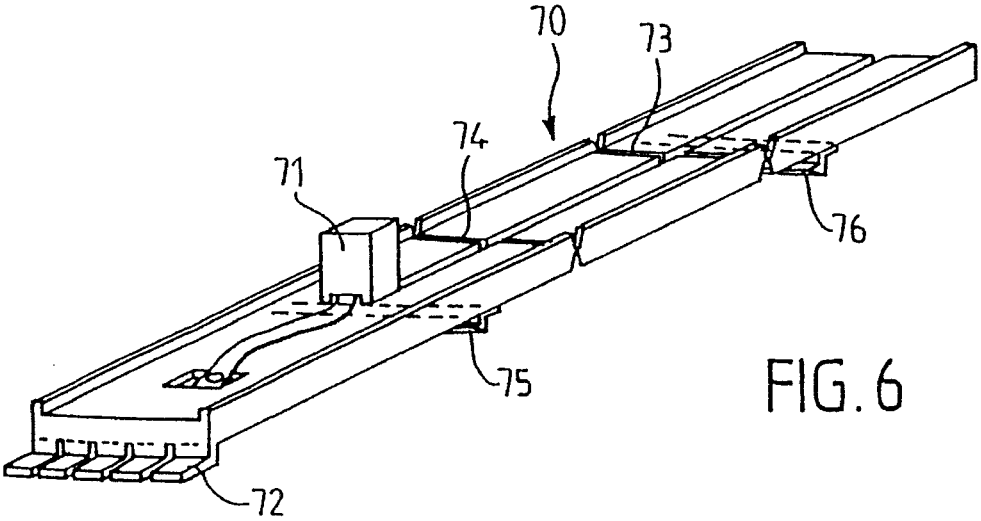
FIG. 6 represents a support fitted with a spring-loaded pusher.

FIG. 6 also shows another accessory for the display rack of the invention. This is a support 70 fitted with a spring-loaded pusher 71. The support 70 is fitted, at one of its ends, with cleavable elements 72 enabling fastening the support 70 to the third edge 7 of an element 2 of the display rack. The support 70 also comprises breaks 73 and 74 enabling cutting the support 70. Moreover, the support 70 is fitted with fastening profiles 75 and 76 whose overall shape is elongated, whereas they are arranged crosswise with respect to the longitudinal stretch of the support 70. The fastening profiles 75 and 76 enable fastening the support 70 into the recesses 23 and 24 of an element 2. The fastening profiles 75 and 76 can be fitted with fastening heads or hooks, corresponding to those represented in FIGS. 2 and 4, respectively.

Figure 7:
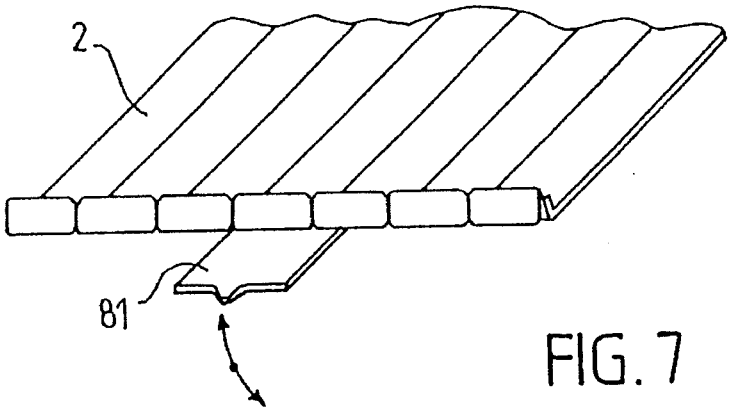
FIG. 7 represents the front rim of an element of the invention display rack, exhibiting a pivoting portion.
Figure 8:
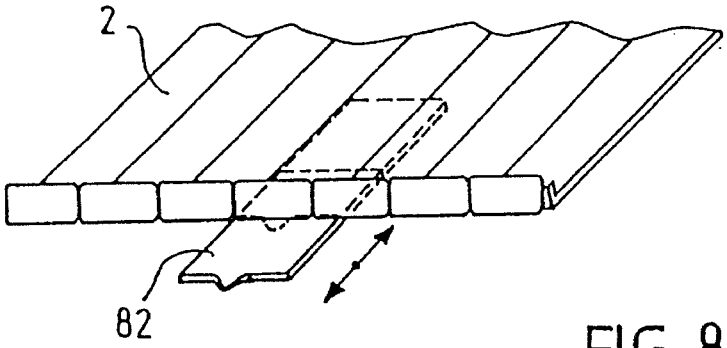
FIG. 8 represent an element of the invention display rack fitted with a sliding compartment.

As a variant to the front panels 9 described above, designed to carry information relating to the objects stored on the display rack, the element 2 of the display rack can be fitted with pivoting flaps 81 or sliding flaps 82, represented in FIGS. 7 and 8, respectively. The sliding flaps and the pivoting flaps can be of any appropriate size. More particularly, these flaps can be less wide than an element 2 or, conversely, be wider to such an extent that they span at least partially two or several elements of the display rack.

Figure 9:
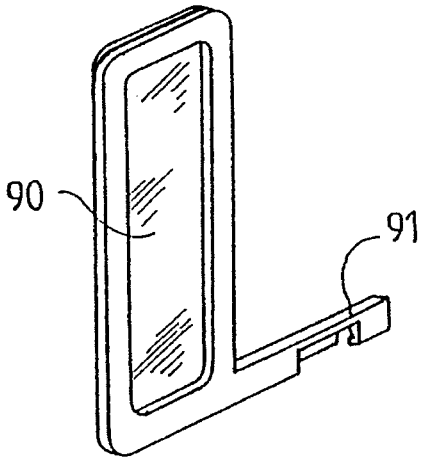
FIG. 9 represents a sign designed to be mounted on an element separator of the invention display rack.

FIG. 9 shows another accessory of the display rack of the invention. This a flat sign 90 whose general shape is rectangular. The sign 90 is fitted with an arm 91 formed in such a way that it could be clipped to a partition 41 described above. More especially, the arm 91 is arranged on the same plane as that of the stretch of the sign 90 and directed so that the latter protrudes from the front edge 7 of the display rack or beyond the front panel 9. The fastening of the sign 90 by means of the arm 91 corresponds preferably to the fastening principle of the extension 43 described above while referring to FIG. 4.

The sign enables placing interchangeable messages, either by affixing self-adhesive tags or by inserting cardboard tags when the sign has been produced with a frame for this purpose.

Figure 10:
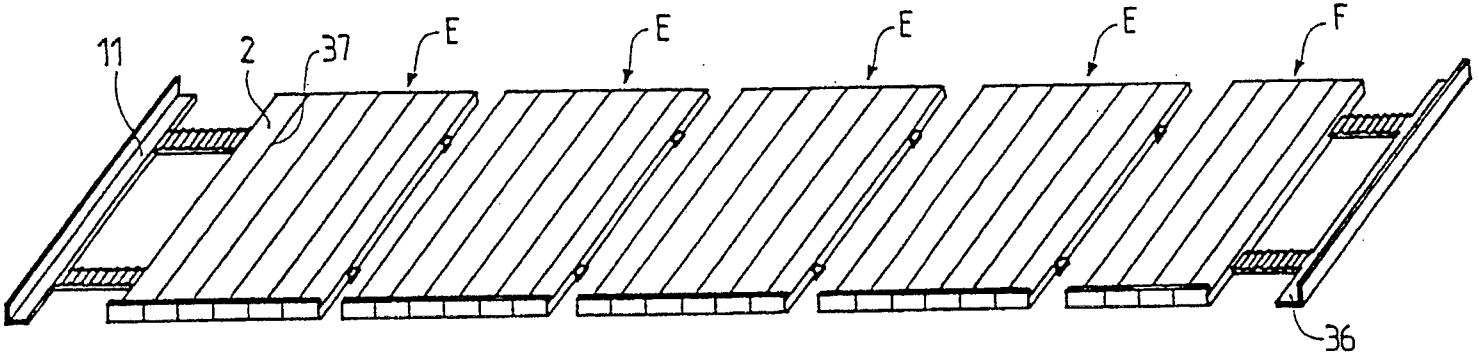
FIG. 10 represents, quite schematically, a display rack according to an alternate embodiment of the preferred embodiment of the invention.

FIG. 10 represents quite schematically a display rack according to the invention, comprising a plurality of elements 2, a sliding rim 11 and another sliding rim 36. In order to simplify this Figure, the removable separators 27 have not been represented.

For practical reasons of use, the elements 2 of the display rack represented can be manufactured in the form of assemblies E, whereas each assembly E contains six elements 2. The assemblies E are then moulded to one single piece and comprise cleavable areas 37 enabling easy separation of an element 2 from the assembly E. The display rack comprises four assemblies E. The fifth assembly, referred to as F, has been obtained by removing two elements 2 from an assembly E. In order to adjust the width of the display rack exactly to the necessary value in relation to the sizes of the objects to be stored and to the space requirements for the quantity of necessary removable separators, the sliding rims 11 and 36 have been placed in position respectively in relation to the corresponding element 2 on which they are mounted.

Attachment of the various assemblies E and F is provided by dovetails which the first edge 5 and the second edge 6 of the corresponding elements 2 have been fitted with. According to the arrangements shown in FIGS. 1 and 10, every element 2 is fitted with two male dovetails 38 arranged on the second edge 6 of the element and of two female dovetails 39 arranged on the first edge 5 of the element. The male dovetails 38 and the female dovetails 39 are respectively arranged on the first edge 5 and the second edge 6 of the element 2 so that the male dovetails 38 cooperate with the female dovetails 39 during the assembly of both elements 2.

The number of dovetails arranged on the edges 5, 6 of the element 2 may of course vary according to the length of the element 2 as well as the conditions of use of the display rack. It is also conceivable that the first edge 5 and the second edge 6 are fitted with male dovetails 38 and female dovetails 39 at the same time. In such a configuration, the type of every male dovetail 38 and female dovetail 39 arranged on the first edge 5 must be complementary to the type of dovetails located in an appropriate way on the second edge 6.

Generally, the dovetails are formed integrally in as well as on the edges 5 and 6 of the element 2. However, it is conceivable to use parts 381 (see FIG. 1A) whose overall shape is that of a double dovetail, designed to be inserted into appropriate recesses in the edges 5 and 6. The shape of these recesses matches that of the female dovetails 39.

According to an alternate embodiment (non-represented) of the embodiment shown in FIG. 10, the display rack contains only one sliding unit, either 11 or 36. The other sliding unit is replaced with an element which corresponds solely to the leg 13 described above. This element is fitted with male 38 or female 39 dovetails in order to be fixed to the corresponding edge 5 or 6 of an element 2.

I claim:

1. Display rack for shelves adapted to display objects comprising:

a base defining an adjustable storage area, said base comprising a plurality of juxtaposed elements and at least one sliding rim;

each of said plurality of juxtaposed elements comprising a first edge and a second edge accommodating said sliding rim, a storage surface and a plurality of recesses in said storage surface; and at least one separator capable of separating two rows of objects to be displayed, each said at least one separator comprising a plurality of fastening elements capable of interacting with said plurality of recesses to removably affix said at least one separator.

2. The display rack according to claim 1, wherein each of said plurality of juxtaposed elements is substantially rectangularly-shaped comprising two longer sides comprising said first edge and said second edge.

3. The display rack according to claim 1, wherein each of said plurality of juxtaposed elements comprises at least one guiding element to enable movement along said sliding rim.

4. The display rack according to claim 3, wherein each of said plurality of juxtaposed elements comprises at least one locking element to prevent movement of each of said plurality of juxtaposed elements relative to said sliding rim.

5. The display rack according to claim 1, wherein said sliding rim comprises an angular profile comprising a first leg positioned in a plane parallel to a plane passing through said storage surface, and a second leg comprises a bearing surface for objects to be stored; and at least one sliding block integral with said angular profile so as to form a sliding plane that is parallel to said plane passing through said storage surface.

6. The display rack according to claim 5, wherein said at least one sliding block comprises a flat corrugated profile perpendicularly positioned to a plane longitudinally extending through said angular profile.

7. The display rack according to claim 1, wherein said plurality of recesses are groove-shaped and comprise ends directed crosswise in relation to said first edge and said second edge.

8. The display rack according to claim 7, wherein said recesses are substantially rectangularly-shaped.

9. The display rack according to claim 1, wherein said at least one separator comprises a partition constructed and arranged to be mounted at an angle to said storage surface, and at least one fastening arm comprising one end attached to said partition and a second end fitted with a fastening head, said fastening head being offset with respect to a plane of symmetry passing through said partition.

10. The display rack according to claim 1, wherein each of said plurality of juxtaposed elements comprises a third edge, a front rim is fitted on said third edge, and said front rim is constructed and arranged to accommodate a front panel capable of carrying various pieces of information.

11. The display rack according to claim 10, further comprising a front panel, and said front panel comprises a profile cut to a length of at least a portion of a juxtaposed element, and attached to said front rim.

12. The display rack according to claim 1, wherein each of said first edge and said second edge is fitted with connecting elements for connecting juxtaposed elements to each other.

13. The display rack according to claim 12, wherein said connecting elements comprise at least two dovetails, with said at least two dovetails comprising complementary pairs of female and male dovetail connectors positioned on said first edge and said second edge.

14. Display rack for shelves comprising:

a base defining an adjustable storage area, said base comprising a plurality of juxtaposed elements and at least one sliding rim;

each of said plurality of juxtaposed elements comprising a first edge, a second edge and a storage surface and a plurality of recesses in said storage surface; and at least one separator comprising a plurality of fastening elements capable of interacting with said plurality of recesses to removably affix said at least one separator.

15. The display rack according to claim 14, wherein each of said plurality of juxtaposed elements is substantially rectangularly-shaped comprising two longer sides comprising said first edge and said second edge.

16. The display rack according to claim 15, wherein each of said plurality of juxtaposed elements comprises at least one guiding element to enable movement along said sliding rim; and each of said plurality of juxtaposed elements comprises at least one locking element to prevent movement of each of said plurality of juxtaposed elements relative to said sliding rim.

17. The display rack according to claim 16, wherein said sliding rim comprises an angular profile comprising a first leg positioned in a plane parallel to a plane passing through said storage surface, and a second leg comprises a bearing surface for objects to be stored; and at least one sliding block integral with said angular profile so as to form a sliding plane that is parallel to said plane passing through said storage surface.

18. The display rack according to claim 17, wherein said at least one sliding block comprises a flat corrugated profile perpendicularly positioned to a plane longitudinally extending through said angular profile.

19. The display rack according to claim 17, wherein each of said first edge and said second edge is fitted with connecting elements for connecting juxtaposed elements to each other.

20. The display rack according to claim 14, wherein said at least one separator comprises a partition constructed and arranged to be mounted at an angle to said storage surface, and at least one fastening arm comprising one end attached to said partition and a second end fitted with a fastening head, said fastening head being offset with respect to a plane of symmetry passing through said partition.

21. The display rack according to claim 20, comprising an elongated extension, and means for affixing said elongated extension to said partition so that said extension and partition are positioned in a same plane.

22. The display rack according to claim 14, wherein said plurality of juxtaposed elements comprise juxtaposed elements having more than one shape.

* * * * *

UNITED STATES PATENT AND TRADEMARK OFFICE

CERTIFICATE OF CORRECTION

PATENT NO. : 5,458,248

DATED : October 17, 1995

INVENTOR(S) : Alain FRANCOIS

It is certified that error appears in the above-indentified patent and that said Letters Patent is hereby corrected as shown below:

On the title page, item [75]: "Inventor", change "Francois Alain," to ---Alain Francois,---.

At column 1, line 25, change "drawbacks afore mentioned." to ---above-discussed drawbacks.---.

At column 2, line 18, change "circular" to ---a circle---.

At column 3, line 14, after "plane," insert ---i.e.,---.

At column 4, line 6, before "and" (first occurrence) insert ---3---.

At column 6, line 27, change "Of" to ---Of---.

Signed and Sealed this

Tenth Day of September, 1996

Bruce Lehman

*Attest:*

BRUCE LEHMAN

*Attesting Officer*

*Commissioner of Patents and Trademarks*